US005490443A

United States Patent [19]

Atsuta

[11] Patent Number: 5,490,443

[45] Date of Patent: Feb. 13, 1996

[54] PRESSURE-DISCHARGED TYPE RETAINING SYSTEM

[76] Inventor: Yuzuru Atsuta, 12-5, Kanahodo 2-Chome, Asao-Ku, Japan

[21] Appl. No.: 179,746

[22] Filed: Jan. 11, 1994

Related U.S. Application Data

[63] Continuation of Ser. No. 827,797, Jan. 30, 1992, abandoned, which is a continuation of Ser. No. 445,660, Dec. 13, 1989, abandoned.

[30] Foreign Application Priority Data

Apr. 13, 1988 [JP] Japan ..... 63-90688

[51] Int. Cl.[6] ..... F15B 15/26

[52] U.S. Cl. ..... 92/27; 92/28; 91/44

[58] Field of Search ..... 92/27, 28; 91/44, 91/45

[56] References Cited

U.S. PATENT DOCUMENTS

| | | | |
|---|---|---|---|
| 3,150,571 | 9/1964 | Frasseto et al. | 92/28 |
| 3,286,602 | 11/1966 | Butner et al. | 92/28 |
| 4,534,269 | 8/1985 | Scerbo et al. | 92/27 |
| 4,781,102 | 11/1988 | Scerbo et al. | 91/45 |
| 5,235,896 | 8/1993 | Huber | 91/44 |

*Primary Examiner*—Thomas E. Denion

[57] ABSTRACT

A pressure-discharged type retaining system is designed so that supplying and discharging of a high-pressure fluid permits the relative movement of an annular outer member and an inner member inserted and fitted therein in either or both of axial and circumferential directions and retains the outer and inner members stationary. In the prior art, to insure the smoothness and safety of the operation, a high processing accuracy, a measuring accuracy and the like have been required in the production of such a system, resulting in an increased cost. According to the present invention, either one of the adjacent inner and outer members is formed, on its outer or inner surface, with a metal layer which has a predetermined difference in hardness from that of the other member, thereby solving the above subject. The system of the present invention has high reliability and safety and can be conveniently used for retaining the relatively moving components stationary in an operational position or for adjusting the speed of movement of them in any of a crane, a rocket launcher, a hopper, a dam gate, a lifter, a nuclear plant, a crusher, various testing machines and the like.

6 Claims, 3 Drawing Sheets

PRESSURE-DISCHARGED TYPE RETAINING SYSTEM

PRIORITY

This application is a continuation of application Ser. No. 07/827,797 filed on Jan. 30, 1992 which was a continuation of application Ser. No. 07/445,660 filed on Dec. 13, 1989 both now abandoned.

TECHNICAL FIELD

The present invention relates to a pressure-discharged type retaining system designed to bring an annular outer member and an inner member inserted and fitted therein into their relatively movable states and to retain both of the outer and inner members in their stationary states incapable of relative movement.

TECHNICAL BACKGROUND

Various proposals have conventionally been made to bring the outer and inner members into their relatively movable states and to retain them stationary.

Such prior art systems include those disclosed in Japanese Patent Publication Nos. 24,290/63; 22,076/70; 29,346/70; and 22,074/73.

In any of means described in these patents, supplying of a high-pressure oil causes one of the outer and inner members to be radially expanded or shrinked toward the other, thereby bringing them into their stationary states, while releasing of the high-pressure oil causes the one member to be shrinked or expanded away from tile other, thereby bringing them back into their relatively movable states. However, if supplying of the high-pressure should be stopped due to any trouble generated in an oil pressure source, both of the members may come into relatively movable states, and there is a fear that relative movement of the members may occurs inadvertently to cause any unexpected accident.

In order to overcome the above problem, a pressure-discharged type retaining system has been proposed and used which is designed so that when a high-pressure fluid is supplied, the outer member is expanded radially, whereby both of the inner and outer members are brought into relatively movable states, and when the high-pressure fluid is discharged, the both members .are put into a close fit and retained stationary. In this system, an oil pressure is applied between a cylinder which is the outer member and a piston which is the inner member, thereby expanding the peripheral wall of the cylinder, so that the piston can be driven, and releasing of the oil pressure from between the cylinder and the piston causes the cylinder to be shrinked to its original state, thereby retaining the piston stationary.

With such a construction, however, in order to ensure the stationary retaining by a close fit, both of the piston and the cylinder are made of a tough material such as a high strength steel, a stainless steel or the like and hence, there is a fear that dragging may be produced between the inner peripheral surface of the cylinder and the outer peripheral surface of the piston, or leakage of the high-pressure oil supplied between these inner and outer peripheral surfaces may occur, or the piston may be accidentally put into a close fit with the cylinder in the course of assembly, with the result that the piston cannot be further inserted into the cylinder.

Therefore, there is a conventionally known system comprising a cylindrical liner interposed between the cylinder and the piston and made of a material such as bronze or the like having a lower hardness than those of the cylinder and the piston, wherein an oil pressure is applied between the outer peripheral surface of the piston and the inner peripheral surface of the cylinder to expand the cylinder along with the liner, so that the piston can be thereby driven. In this system, the piston can be retained stationary in a condition of the oil pressure released and hence, the safety is extremely high. Moreover, since the liner is formed from a relatively soft material, dragging to the piston or the like cannot be produced, and a situation incapable of assembling cannot be also generated during assembling.

DISCLOSURE OF THE INVENTION

However, the prior art system using the liner has the following disadvantage:

In this type of the pressure-discharged retaining system, portions participating in the stationary retaining must be made with a severe dimensional accuracy, because of a need for a reliable stationary retaining. To this end, an extremely high dimensional accuracy is required not only for the cylinder and the piston but also for the liner. This dimensional accuracy includes a true circularity, a true cylindricality, a concentricity, and a true straightness. To make a cylinder, a piston and a liner while satisfying a variety of such requirements in dimensional accuracy, extremely high processing and measuring accuracies are required, resulting in a difficulty to produce them and in an increased cost. Another problem is that because the cylinder and the piston are retained stationary through the liner rather than directly, so that they cannot be relatively moved, the cylinder and the piston are required to be subjected to thermal treatments such as hardening and tempering, resulting in a further difficulty to produce them.

The present invention has been accomplished with the foregoings in view, and it is an object of the present invention to provide a pressure-discharged type retaining system which has an extremely good stationary retaining capacity and still can De extremely easily made at a very low cost without requiring high dimensional and processing accuracies and any thermal treatments.

To achieve the above object, a pressure-discharged type retaining system according to the present invention comprises an inner member inserted and fitted in an annular outer member so that a high-pressure fluid can be supplied to and discharged from between an inner peripheral surface of said outer member and an outer peripheral surface of said inner member, and supplying of said high-pressure fluid causes the outer member to be expanded so that the outer and inner members are relatively movable, while discharging of said high-pressure fluid causes the outer and inner members to be brought into a close-fit and retained in a stationary state in which they cannot be moved relatively, wherein either one of the inner peripheral surface of said outer member and the outer peripheral surface of said inner member is formed with a metal layer having a predetermined difference in hardness from that of the other member.

With the pressure-discharged type retaining system of the present invention constructed in this manner, the disadvantages associated with the above-described prior art systems can be overcome.

More specifically, the metal layer integrally formed on one of the outer and inner members and having a hardness different from that of the other member is adapted to be brought into press contact with the other member and hence, dragging can be prevented from occurring between both the members. Moreover, since the both members can be retained stationary in a condition of the high-pressure fluid discharged, an extremely high safety can be assured. In addition, since the metal layer having a different hardness may be integrally formed on either one of the members, so that the metal layer and the other member may be brought into a close fit with each other, high dimensional and processing accuracies are not required for the both members and further, any thermal treatments are unnecessary. This makes it possible to produce the system easily and inexpensively.

The pressure-discharged type retaining system according to the present invention is constructed and operates as described above and moreover, provide the following effects: The system is capable of providing a stationary retaining with an extremely high reliability as indicated by results of various experiments which will be described hereinafter. In addition, the system has an extremely good stationary retaining capacity and still, can be extremely easily made at a very low cost without requiring high dimensional and processing accuracies as well as any thermal treatments.

THE BEST MODE FOR CARRYING OUT THE INVENTION

Embodiments of the present invention will now be described with reference to FIGS. 1 to 5.

Figure 1:
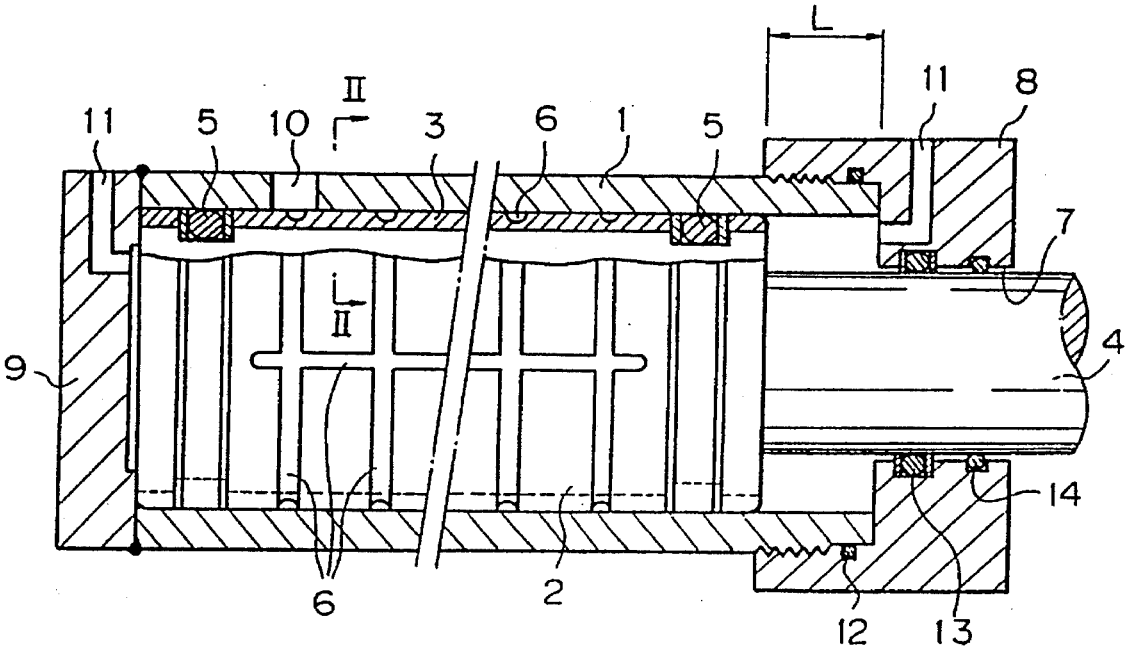
FIG. 1 is a partially sectional front view of one embodiment of a pressure-discharged type retaining system of the present invention.
Figure 2:
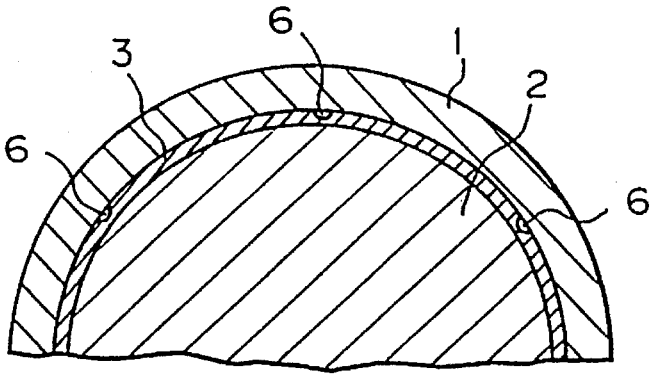
FIG. 2 is a sectional view taken along a line II—II in FIG. 1.
Figure 3:
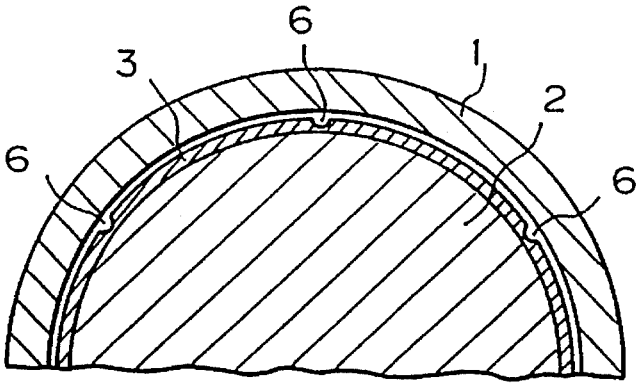
FIG. 3 is a sectional view similar to FIG. 2, but with a retaining releasing force applied.

FIGS. 1 to 3 illustrate one embodiment of the present invention, wherein a cylinder 1 is used for an outer member, and a piston 2 is used for an inner member. Both of the cylinder 1 and the piston 2 are made of a tough material such as Cr—Mo steel, STK steel and the like. An outer peripheral surface of the piston 2 is integrally formed with a metal layer 3 such as bronze having a predetermined difference in hardness from that of a material for the cylinder 1. This metal layer 3 is integrally formed by melting and depositing such a metal on the outer peripheral surface of the piston 2 in a padding manner and abrading the resulting outer peripheral surface circumferentially. The piston 2 is received in the cylinder 1 so that the both of them may be retained in their stationary states incapable of relative movement by a close fit in a free condition where a high-pressure fluid such as a working oil is not supplied between an outer peripheral surface of the metal layer 3 and inner peripheral surface of the cylinder 1. The piston 2 is integrally formed, at its one end, with a rod 4 having a diameter smaller than that of the piston 2.

In addition, an outer periphery of the piston 2 is provided, at its opposite ends, with sealing members 5, 5 which may come into close contact with an inner peripheral surface of the cylinder 1, and the outer peripheral surface of the piston 2, i.e., the outer peripheral surface of the metal layer 3 is provided with a suitable number of grooves 6 at predetermined distances axially and circumferentially spaced apart from one another. A lid member 8 is attached to an end of the cylinder 1 closer to the rod 4 by means such as threaded engagement and has a through hole 7 centrally made therein, through which the rod 4 is passed. A plate-like closing member 9 is secured to the other end of the cylinder 1 by welding or by another technique to cover the other end of the cylinder 1. A high-pressure supplying and discharging hole 10 is made at a place on the outer peripheral surface of the cylinder 1 and inside the individual sealing members 5, 5 for introducing a high-pressure fluid between the cylinder 1 and the piston 2, and piston oil holes 11, 11 are made respectively in outer peripheries of the lid member 8 and the closing member 9 of the cylinder 1 for introducing a drive oil for axially driving the piston 2 to opposite end face portions of the piston 2. A sealing member 12 such as an 0-ring or the like is interposed between the lid member 8 and the cylinder 1, and a sealing member 13 such as a mechanical seal or the like is interposed between the lid member 8 and the rod 4. Further, a dust seal 14 is interposed at an axial end.

The operation of this embodiment will be described below.

In this embodiment, in a normal condition where no high-pressure fluid is supplied between the inner peripheral surface of the cylinder 1 and the outer peripheral surface of the metal layer 3, the piston 2 is retained stationary by a close fit in the cylinder 1 which is in a shrinked state, as shown in FIGS. 1 and 2, so that the piston 2 cannot be driven.

When the piston 1 is to be driven, the high-pressure fluid is first supplied through the high-pressure fluid supplying and discharging hole 10, and if doing so, the high-pressure fluid supplying and discharging hole 10 is brought into communication between the metal layer 3 and the cylinder 1 through the individual grooves 6. The resulting pressure causes the cylinder 1 to be expanded radially outwardly, thereby releasing the stationary retaining of the piston 2, as shown in FIG. 3. In this state, an oil is then supplied through the piston oil hole 11, thereby causing the piston 1 to be driven by a desired amount within an extent of an axial length L. In this case, if the oil is supplied through the piston oil hole 11 in the lid member 8, the piston 2 is moved rightwardly as viewed in FIG. 1, on the one hand, and if the oil is supplied through the piston oil hole 11 in the closing member 9, the piston 2 is moved rightwardly as viewed in FIG. 1, on the other hand.

Then, when the high-pressure fluid is discharged from between the cylinder 1 and the metal layer 3 through the high-fluid supplying and discharging hole 10, the pressure applied to the cylinder is reduced, so that the cylinder 1 is shrinked back to its original state by a resilience to retain the piston 2 stationary again.

Alternatively, the amount of high-pressure fluid supplied may be increased or decreased to axially move the piston 2 at a desired speed while braking it with some clamping force applied to the piston 2 by the cylinder 1.

Accordingly, in the present embodiment, since the metal layer 3 is formed on the outer peripheral surface of the piston 2, so that the piston 2 is brought into a press contact with the inner peripheral surface of the cylinder 1 through the metal layer 3, dragging or the like to the cylinder 1 can be prevented from occurring, and moreover, the piston 2 can be retained stationary in a condition of the high-pressure fluid discharged, thereby insuring an extremely high safety. In addition, since the metal layer 3 can be formed only by padding a metal onto the piston 2 and then abrading the outer peripheral surface of the padded metal, high dimensional and processing accuracies for the piston 2 are not required, and further, any thermal treatment is unnecessary. This makes it possible to easily produce a pressure-discharged type retaining system at a low cost.

Alternatively, the metal layer 3 may be formed by securing an element formed into a cylindrical liner onto the outer peripheral surface of the piston 2, or may be integrally formed on the outer peripheral surface of the piston by any other means such as depositing.

Figure 5:
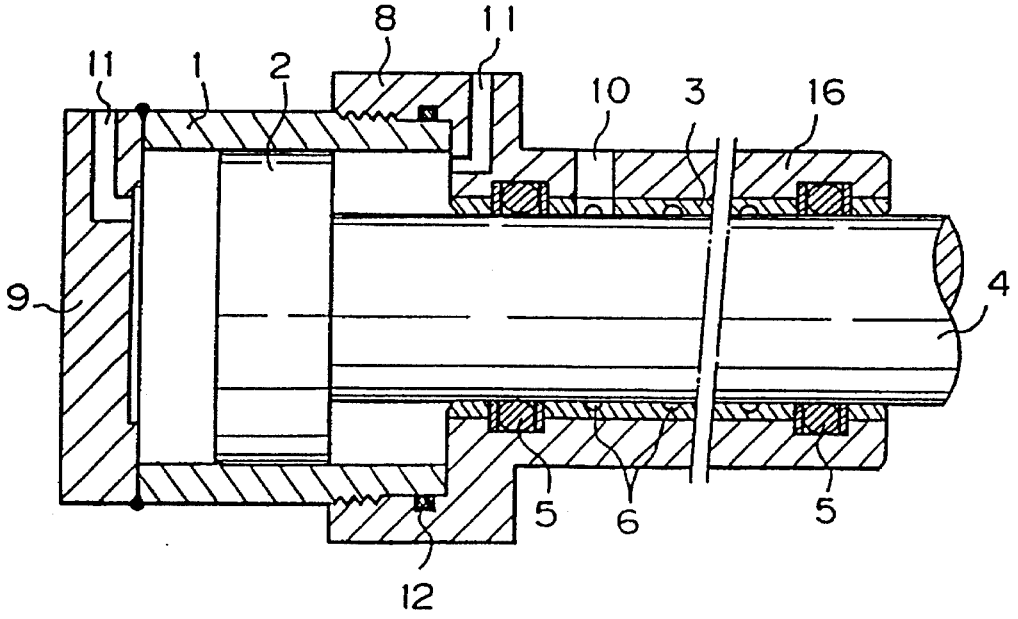
FIG. 5 is a schematic view illustrating a construction of a further embodiment of the present invention.
Figure 4:
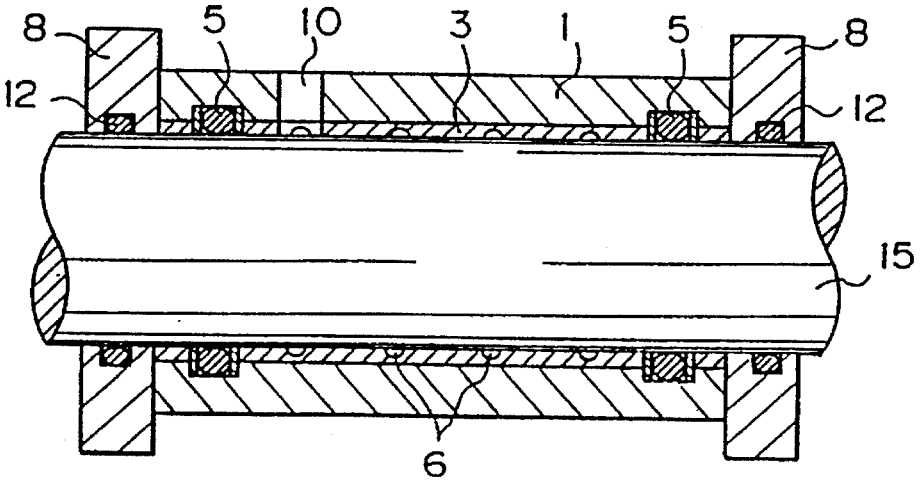
FIG. 4 is a schematic view illustrating a construction of another embodiment of the present invention.

It will be understood that the present invention is not limited to the above embodiment, and modifications can be made if necessary. For example, in place of the piston 2, a rotary shaft 15 may De mounted, as shown in FIG. 4, so that it can be rotated or retained stationary. In the present embodiment, the metal layer 3 and the sealing members 5, 5 are mounted on the inner peripheral surface of the cylinder 1. Alternatively, the metal layer 3 may be axially divided into a plurality of portions which may be axially spaced apart from one another at predetermined distances, so that a high-pressure fluid can be also supplied to and discharged from the resulting annular spaces. In addition, as shown in FIG. 5, the inner member may be a rod 4 connected to a piston 2, while the outer member may be a rod support member 16 for supporting the axial movement of the rod 4, and a metal layer 3 having grooves 6 made therein and sealing members 5, 5 may be provided on the inner surface of the rod support member 16.

Description will be made of results of experiments for the reliability of the operation of the pressure-discharged type retaining system made according to the present invention.

DESCRIPTION OF THE SYSTEM OF THE PRESENT INVENTION REGARDING EXPERIMENTS

The system of the present invention was used which has a construction similar to that shown in FIG. 1 and having design conditions of an outside diameter of the piston 2 (metal layer 3) of 100 mm, a diameter of the rod 4 of 56 mm, a stroke of 30 mm, a force for releasing the retaining by the cylinder 1 of 300 kg/cm$^2$, and a stationary retaining force, i.e., a load supportable by the piston 2 of 15 t.

1) Operation Test

Figure 6:
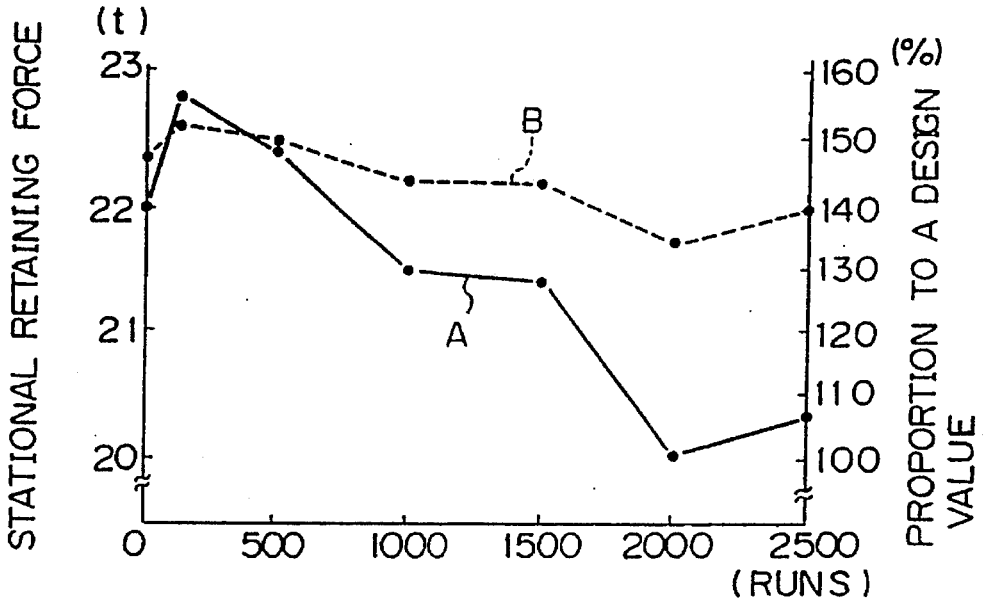
FIG. 6 is a characteristic graph illustrating a variation in stationary retaining force with respect to the number of operations.

The continuous operation of the piston comprising the releasing of the stationary retaining from a stroke position, the advancing by the entire stroke, the stationary retaining, the releasing of the stationary retaining, the retreating by the entire stroke was repeated 2,500 runs, and variations in stationary retaining force in the stroke positions were determined. Results of such operation test are shown by a line A in FIG. 6A. A line B in FIG. 6 indicates the proportions of the individual values to the design condition. In this case, the temperature of a working oil as a high-pressure fluid was of 23° C. to 38° C., and the atmospheric temperature was of 22° C. to 28° C.

It can be seen from the results that if the piston is operated 2,000 or more runs, the stationary retaining force is slightly decreased, but still, a retaining force extremely higher than the design value of 15 t can be obtained.

2) Test for Stationary Retaining Force

Figure 7:
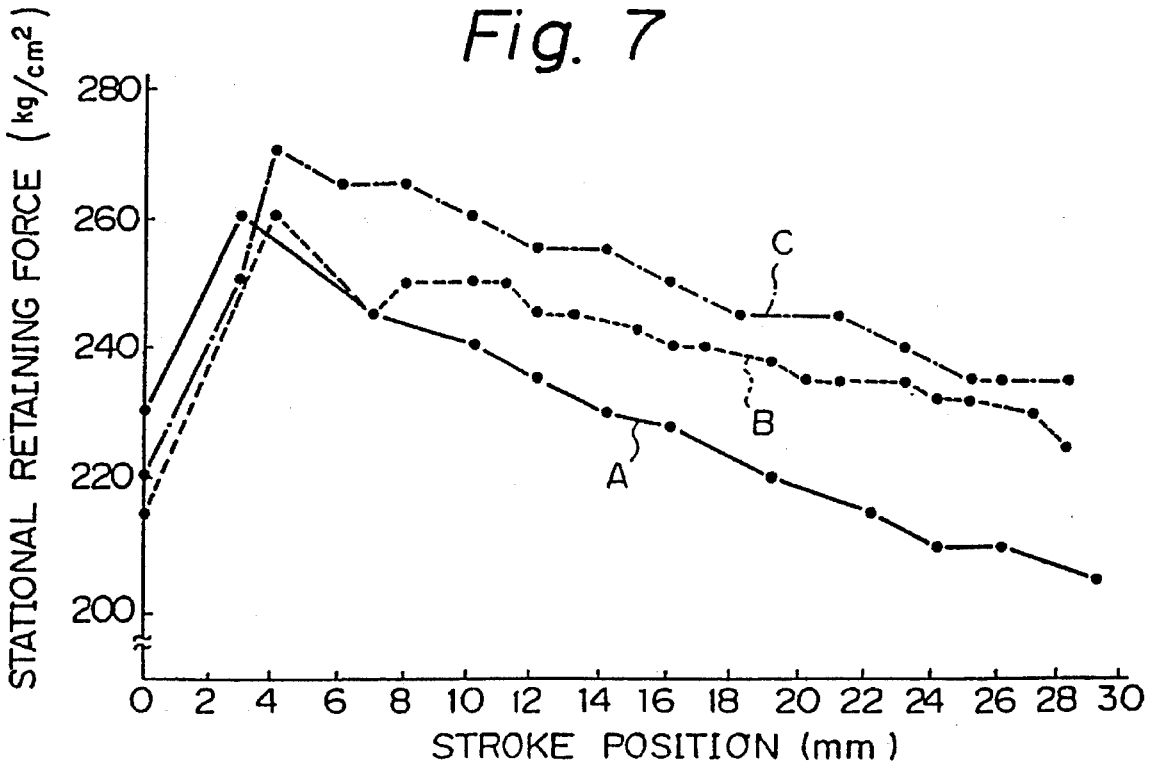
FIG. 7 is a graph illustrating values of stationary retaining force in individual stroke positions of a cylinder.

Results of determination of the stationary retaining force on the piston in individual stroke positions are shown in FIG. 7.

In FIG. 7, a line A indicates values of the stationary retaining force in the individual stroke positions when the 2,500 runs of the above-described operation test have been completed, and lines B and C indicate values of the stationary retaining force when a subsequent slip durability test has been carried out 20 and 40 runs, respectively. The stationary retaining force is shown as a value per unit area applied to the piston 2, and 15 t of the design condition corresponds to 191 kg/cm .

The slip durability test comprises applying an overload to the rod 4 to move, by the entire stroke, the piston 2 which is in a stationarily retained state where the high-pressure fluid has been discharged.

It can be seen from the results of this durability test that even the lowest retaining force can reliably retain the piston.

3) Other Tests

After the above-described operation test, the test for the stationary retaining force in the individual positions of the stroke was carried out two runs; a test for the responsibilities of the lowest operational pressure and the stationary retaining force was carried out, and the slip durability test was carried out 70 runs or more.

More specifically, in the slip durability test, the pressure was determined which was applied to the piston at the start of a slip of the piston from a position of zero stroke with a pressure loaded on the piston being raised after stationary retaining of the piston, but the slip starting pressure remained maintained sufficiently larger than the rated stationary retaining force.

In addition, the slip durability test was carried out, but a sufficient large stationary retaining force was likewise maintained.

Further, in view of variations in oil and room temperatures and in environment for use, individual tests and a responsibility test similar to those described above were carried out under various different conditions, and as a result, a sufficient large stationary retaining force and an early responsibility could be obtained in the entire range of such conditions.

It can be seen even from the above results of the above-described tests that the operation of the system according to the present invention has a high reliability.

POSSIBILITY OF INDUSTRIAL APPLICATION

The pressure-discharged type retaining system according to the present invention is certainly and safely operable with a high reliability in such a manner that the inner and outer members can be retained stationary so that their relative movement may be impossible, or they can be moved relatively. Accordingly, the system according to the present invention can be conveniently used for retaining the relatively moving components stationary and adjusting the speed of movement of them in any of a crane, a rocket launcher, a hopper, a dam gate, a lifter, a nuclear plant, a crusher, various testing machines and the like.

What is claimed is:

1. A pressure-discharged type retaining system comprising:

a. a cylindrical inner element comprising:

(i) an inner portion having an outer peripheral surface;

(ii) an outer layer integrally formed onto said inner portion, said outer layer made of a softer material than said inner portion, and said outer layer being integrally formed onto said outer portion by melting and depositing said softer material on said inner portion to cover said outer peripheral surface of said inner portion;

said inner element having a convex surface having a plurality of interconnected grooves axially spaced apart from one another;

b. a tubular outer element having a bore close fit to said cylindrical element for receiving said cylindrical element so that both elements are incapable of relative movement, said outer element being capable of resilient expansion;

c. means for supplying high-pressure fluid between said inner element and said outer element so that said outer element expands, allowing said inner element and said outer element to move relative to one another when said high-pressure fluid supply means is in a pressure-active condition.

2. The pressure-discharged type retaining system of claim 1 wherein said outer layer is bronze having a thickness at least as great as the depth of said grooves.

3. The pressure-discharged type retaining system of claim 2 further comprising actuating means to displace said inner element relative to said outer element, comprising a drive fluid supply operative when said high-pressure fluid supply means is in a pressure-active condition.

4. The pressure-discharged type retaining system of claim 1 wherein said inner member is a shaft and said outer member is a cylinder, said shaft being rotatable within said cylinder when said high-pressure fluid supply means is in the pressure-active condition.

5. A pressure-discharged type retaining system consisting essentially of:

a. a cylindrical inner element comprising:

(i) an inner portion having an outer peripheral surface;

(ii) an outer layer integrally formed onto said inner portion, said outer layer made of a softer material than said inner portion, and said outer layer being integrally formed onto said outer portion by melting and depositing said softer material on said inner portion to cover said outer peripheral surface of said inner portion;

said inner element having a convex surface having a plurality of interconnected grooves axially spaced apart from one another and said outer layer being bronze having a thickness at least as great as the depth of said grooves;

b. a tubular outer element having a bore close fit to said cylindrical element for receiving said cylindrical element so that both elements are incapable of relative movement, said outer element being capable of resilient expansion;

c. means for supplying high-pressure fluid between said inner element and said outer element so that said outer element expands, allowing said inner element and said outer element to move relative to one another when said high-pressure fluid supply means is in a pressure-active condition;

d. actuating means to displace said inner element relative to said outer element, comprising a drive fluid supply operative when said high-pressure fluid supply means is in a pressure-active condition; and e. axially-spaced sealing members extending circumferentially of said outer element and said inner element between said outer element and said inner element beyond opposite ends of said plurality of grooves to confine said high-pressure fluid.

6. A pressure-discharged type retaining system comprising:

a. a unitary heterogeneous cylindrical inner element having a bronze exterior metallurgically bonded to a ferrous interior said exterior being convex and having a plurality of interconnected grooves axially spaced apart from one another;

b. a tubular outer element having a bore close fit to said cylindrical element for receiving said cylindrical element so that both elements are incapable of relative movement, said outer element being capable of resilient expansion;

c. means for supplying high-pressure fluid between said inner element and said outer element so that said outer element expands, allowing said inner element and said outer element to move relative to one another when said high-pressure fluid supply means is in a pressure-active condition.

* * * * *